US005775623A

United States Patent [19]

Long

[11] Patent Number: 5,775,623

[45] Date of Patent: Jul. 7, 1998

[54] LOW INERTIA APPARATUS AND METHOD FOR ACCUMULATING AND APPLYING TENSION TO WEBS

[75] Inventor: Michael Long, Rochester, N.Y.

[73] Assignee: Eastman Kodak Company, Rochester, N.Y.

[21] Appl. No.: 879,397

[22] Filed: Jun. 20, 1997

Related U.S. Application Data

[63] Continuation of Ser. No. 676,996, Jul. 8, 1996, abandoned, which is a continuation of Ser. No. 269,295, Jun. 30, 1994, abandoned.

[51] Int. Cl.[6] ..... B65H 23/24

[52] U.S. Cl. ..... 242/417.1; 242/331.3; 226/97

[58] Field of Search ..... 242/417.1, 331, 242/331.3, 552; 226/104, 118, 97

[56] References Cited

U.S. PATENT DOCUMENTS

| | | | |
|---|---|---|---|
| 3,016,207 | 1/1962 | Comstock, 3d | 226/118 X |
| 3,472,436 | 10/1969 | Jura | 226/50 |
| 3,568,907 | 3/1971 | Watson | 226/97 |
| 3,908,920 | 9/1975 | Hermanns | 242/417.1 X |
| 4,053,967 | 10/1977 | Mair | 226/97 X |
| 4,165,132 | 8/1979 | Hassan et al. | 406/10 |
| 4,183,068 | 1/1980 | Barton, Jr. | 226/118 X |
| 4,493,548 | 1/1985 | Ateya | 355/3 FU |
| 5,203,485 | 4/1993 | Cahill et al. | 226/97 |
| 5,209,387 | 5/1993 | Long et al. | 226/97 |
| 5,242,095 | 9/1993 | Creapo et al. | 226/97 |

FOREIGN PATENT DOCUMENTS

| | | |
|---|---|---|
| 3936038A1 | 5/1991 | Germany . |
| A-53-057805 | 5/1978 | Japan . |
| 2254586 | 10/1992 | United Kingdom . |
| 2249782 | 5/1995 | United Kingdom . |

OTHER PUBLICATIONS

IBM Bulletin vol. 17, No. 9, Feb. 1975.

*Primary Examiner*—John Q. Nguyen
*Attorney, Agent, or Firm*—Charles E. Snee, III; Mark G. Bocchetti

[57] ABSTRACT

A web (44) passes over an air bar (40) or metering drum, defines a loop (48, 50, 52) within an open space (46) defined between two pneumatic tensioning wall members (14, 16), and passes over an air bar (42) or metering drum. Pressurized air issues through apertures (36) arranged in rows along web control surfaces (32, 34) to establish curtains of air flowing between the surfaces and the web, thereby applying tension to the web due to the Bernoulli and viscous drag effects.

13 Claims, 3 Drawing Sheets

LOW INERTIA APPARATUS AND METHOD FOR ACCUMULATING AND APPLYING TENSION TO WEBS

This is a Continuation of application Ser. No. 08/676,996, filed 08 Jul. 1996, abandoned, which is a Continuation of application Ser. No. 08/269,295 filed 30 Jun. 1994, which has been abandoned.

DESCRIPTION

1. Field of the Invention

The invention concerns apparatus and methods for applying tension to moving or stationary webs. More particularly, the invention is related to an improved, low inertia technique for accumulating and applying tension to webs using flowing gas.

2. Background of the Invention

In various industrial equipment for making or treating web materials, such as indexing apparatus used to convey and process fragile webs like photographic film, sections of the web in one part of the apparatus may be stopped; others may be moving at essentially constant speed; and still others may be accelerating or decelerating at high rates of speed. In such equipment, there is a need to be able to isolate from one another the sections of the web experiencing different velocities and accelerations. Thus, there is a need to accumulate and release web at high acceleration rates while maintaining a reasonably constant level of tension in the web.

Traditional accumulating devices have created a serpentine path for the web using one or more fixed idler rolls and one or more moving idler rolls mounted to a common frame. The distance between the fixed and moving idler rolls is increased or decreased to accumulate or pay out web. These devices however are not suitable for use at high indexing rates of delicate webs because the forces necessary to overcome the rotational and translational inertia of the moving rollers and their support frame must be supplied by the web and can cause unacceptable variations in web tension.

Another solution to this problem is the conventional vacuum box accumulator, which has no moving parts other than the web and thus solves the inertia force problems of devices using fixed and moveable idler rolls. A loop of web is suspended in a close-fitting box. When a partial vacuum is applied below the loop, with the loop acting as a seal between atmospheric pressure and the partial vacuum, the differential air pressure across the loop tensions the web. Web thus may be added to or removed from the vacuum box at very high acceleration rates while maintaining a relatively constant tension level. Such vacuum boxes are used extensively in magnetic tape transport systems.

Unfortunately, vacuum boxes are not adapted to applications which must accommodate webs of various widths or webs of irregular or varying width. This is because a very close clearance must be maintained between the edges of the web and the inside walls of the vacuum box in order to maintain the partial vacuum. Additionally, there is an associated risk of contact between the face and edges of the web and the walls of the vacuum box, which can scratch the web face or damage the edges. So, a need has existed for a low inertia web tensioner and accumulator which, without disassembly or modification, can readily accommodate changes in width of the web and which minimizes face or edge contact by the web.

SUMMARY OF THE INVENTION

The invention is defined by the claims. Two curtains of high velocity air issue from small passages or apertures through two opposed control surfaces. The control surfaces may be continuous, single surfaces or may be comprised of a plurality of smaller surfaces separated by grooves, channels or open spaces. The curtains of air act together with their respective control surfaces to tension web spans on both sides of a free loop of film by virtue of the Bernoulli and viscous drag effects. The curtains are such that they longitudinally and transversely tension the web and hold it in a stable, vibration free and spaced apart relation with the control surfaces. This arrangement allows for accumulating and tensioning of webs, particularly very thin webs requiring low tension levels. There are no moving parts other than the web; so, there are no inertia forces to overcome, other than the small inertia of the web itself. The apparatus accepts webs of widely varying widths, thus overcoming the width-specific limitations of vacuum boxes. The apparatus and method of the invention offer unique, truly non-contact ways to accumulate and tension webs. The air or other fluid used to provide the curtains also may be used for heating, drying, cooling, oxidizing or otherwise treating the web.

One embodiment of the apparatus of the invention includes at least one first control surface extended between first and second opposite ends and first means for directing flows or a curtain of gas along the first control surface in a direction from the first end toward the second end. At least one second control surface extends between third and fourth opposite ends, the second control surface facing or opposing the first control surface with the first and third ends and second and fourth ends respectively opposite each other. Thus, a space open to ambient pressure is defined between the control surfaces. Second means are included for directing flows or a curtain of gas along the second control surface in a direction from the third end toward the fourth end. Means are provided near the first and third ends for guiding a loop of web into and out of the open space. As a result, the flows of gas support the web out of contact with the control surfaces due to the Bernoulli effect. The flows also apply tension to the web in the direction of the second and fourth ends due to the viscous drag effect.

In one embodiment, the means for directing air flows each comprise a plurality of apertures at acute angles through the respective control surface and means for passing pressurized gas through the apertures. The control surfaces may be elongated parallel to the web, transverse to the web, or at an acute angle to the web. The control surfaces may be broken by axially or transversely extending grooves, or by other patterns of grooves or open channels, for exhausting or venting gas from between the web and the control surfaces. The control surfaces may be comprised from a plurality of smaller, neighboring surfaces having apertures. The neighboring surfaces need not be coplanar. A portion of the apertures may be directed alternately toward opposite edges of the surfaces to apply transverse force to flatten the web toward the surfaces.

When exhaust grooves or channels are used, the apertures may be located centrally on the control surfaces between the grooves, or within the grooves. With the apertures located within the grooves, the grooves may each comprise a curved side adjacent the apertures to reduce flow disturbances between said web and said surfaces. The streams of gas may issue from the apertures at angles tangential to the curved side. With reference to a longitudinal axis between the opposite edges of the control surface, a portion of the grooves may be on each side of the axis and the curved side of each groove may be a side of the groove further from the axis.

One embodiment of the method for applying tension to a web comprises the steps of providing at least one first control surface extended between first and second opposite ends; providing at least one second control surface extended between third and fourth opposite ends, the second control surface facing the first control surface with the first and third ends and second and fourth ends respectively opposite each other, whereby a space open to ambient pressure is defined between the control surfaces; passing a flow or curtain of pressurized gas along each of the first and second control surfaces in directions toward the second and fourth ends; and guiding a loop of web into and out of the space at the first and third ends, so that the flows of gas apply tension to the web in the direction of the second and fourth ends. Preferably, the flows along the control surfaces are laminar rather than turbulent. A portion of the pressurized gas may be directed alternately toward opposite edges of the control surfaces to apply transverse force to flatten the web toward the surfaces.

BRIEF DESCRIPTION OF THE DRAWINGS

The foregoing features and advantages of the invention will be apparent from the following more particular description of the preferred embodiments of the invention, as illustrated in the accompanying drawings.

DETAILED DESCRIPTION OF THE INVENTION

Figure 1:
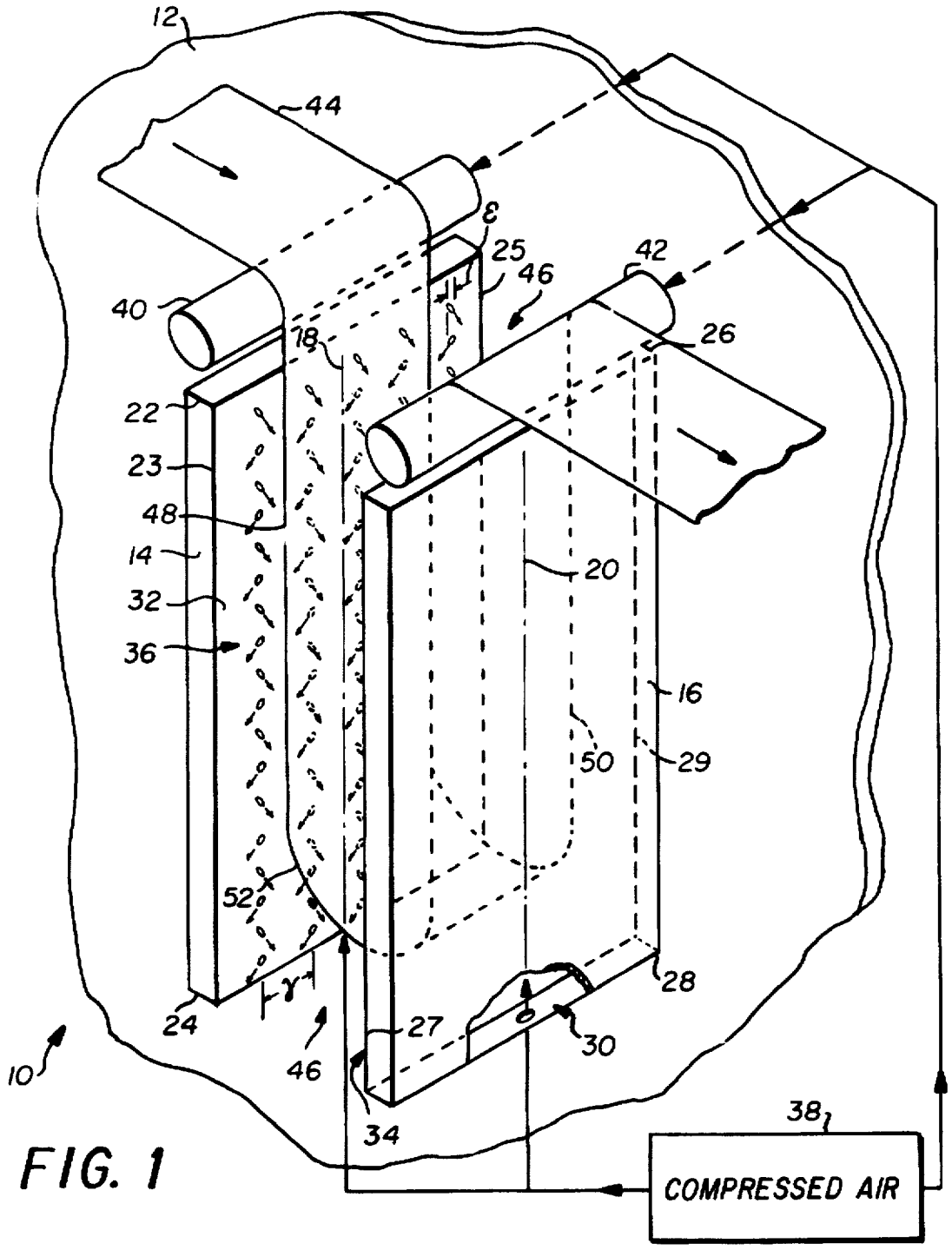
FIG. 1 illustrates schematically a perspective view of the apparatus of the invention.

The following is a detailed description of the preferred embodiments of the invention, reference being made to the drawings in which the same reference numerals identify the same elements of structure in each of the several Figures.

One embodiment of an apparatus 10 according to my invention is illustrated in FIG. 1. A face plate 12 supports upstream and downstream pneumatic tensioning plates or wall members 14, 16, having longitudinally extending axes 18, 20. Wall member 14 comprises an upper first end 22 and an opposite, lower second end 24; and wall member 16, an upper third end 26 and an opposite, lower fourth end 28. Opposite edges 23, 25 extend between ends 22, 24; and opposite edges 27, 29, between ends 26, 28. Typically, the upper and lower ends are positioned opposite one another, as illustrated. Within each wall member, as indicated fragmentarily in FIG. 1, an interior plenum 30 is provided. The wall members comprise respective web control surfaces 32, 34 which extend between the upper and lower ends. The control surfaces face each other and preferably are essentially flat, though a moderate amount of waviness is acceptable. The control surfaces may be arranged vertically or at any convenient angle depending on the weight of the web being tensioned. Also, the control surfaces may be parallel. Plastic webs 152 mm wide and 0.0015 to 0.0064 mm thick and copier paper have been transported successfully at a wide variety of orientations of the control surfaces. The planes of the control surfaces, as extended, may intersect without departing from the scope of my invention. Thus, control surfaces 32, 34 may converge toward or diverge from each other between ends 22, 26 and ends 24, 28.

Figure 2:
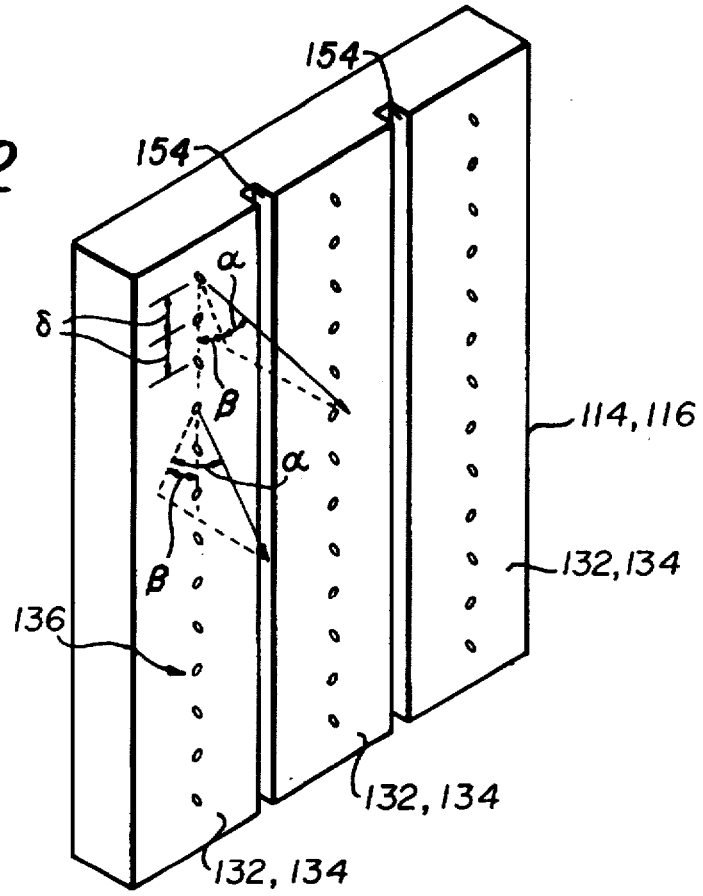
FIG. 2 illustrates schematically a perspective view of the angles of the apertures provided through the surfaces of the plates and the axial grooves for exhausting gas from between the web and the plates.

Each of surfaces 32, 34 is pierced by several longitudinally extended, preferably parallel rows or patterns of passages or apertures 36 which extend from interior plenum 30. For ease of illustration, apertures 36 are shown only through surface 32. A source 38 of pressurized gas, such as air, is connected to the plenums 30; so that, flows of air are emitted from the apertures. As shown in FIG. 2, the axis of each passage or aperture 36, illustrated by an arrow, extends generally toward the second ends 24, 28 at an acute angle $\alpha$ above the associated web control surface. For example, angle $\alpha$ may be approximately 35° to 40°. As a result, flows of air issuing from apertures 36 have substantial components toward ends 24, 28 and tend to establish curtains of air flowing along the web control surfaces.

Conventional cylindrical air bars 40, 42 or conventional metering drums are mounted to face plate 12 just above upper ends 22, 26, respectively, to provide low friction web support and guidance into the apparatus. Very low friction and inertia rollers also could be used. Gas such as air is supplied to the air bars from source 38. Preferably, the planes of the control surfaces, when extended, are approximately tangent to the surfaces of the air bars. A web 44 to be accumulated and tensioned is threaded over air bar 40; into a space 46 between the web control surfaces, space 46 being open at both ends to ambient pressure; and over air bar 42. Thus, an incoming span 48 of the web faces web control surface 32; an outgoing span 50 faces web control surface 34; and a central curved portion 52 of the web joins the two spans to complete a loop between the wall members. As illustrated, wall members 14, 16; the pattern of apertures 36; and air bars 40, 42 all have widths or lengths substantially exceeding the width of web 44. This excess width facilitates threading of the web into the apparatus, enables the apparatus to be used with webs of various widths and even permits simultaneous conveying of two or more webs, side by side.

In operation of the apparatus shown in FIG. 1, web 44 could move intermittently or continuously. Sometimes, the portions of the web upstream of air bar 40 and downstream of air bar 42 could move continuously; other times, one of them could stop; and other times, both of them could stop, depending on the cycle of operation of the associated web transport equipment, not illustrated. During such movement, the flows of air from apertures 36 establish along web control surfaces 32, 34 curtains of high velocity air which impinge on the outer surfaces of the loop to support the loop out of contact with the web control surfaces due to the Bernoulli effect; and, at least, to apply a downward or axial tension to the incoming and outgoing spans of the web due to the viscous drag effect. Depending on the length of the loop and wall members 14, 16, more or less web can be accumulated in the apparatus. Depending on the amount of viscous drag established by the curtains of fluid such as air or other gas, more or less axial tension can be applied to the web.

The lengths of the passages from interior plenum 30 to form apertures 36 should be substantially greater than their diameter in order for the gas streams issuing from the passages to have well-developed flow patterns. Passages 3.81 mm long and 0.46 to 0.71 mm in diameter have been found effective with gas pressure in the range of 1 to 5 kPa, for webs from copier paper to 0.006 mm Mylar. In the embodiments of FIGS. 1 and 2, the passages also may be arranged at a compound angle β of, for example, 20° in an inward, outward or alternating inward, then outward direction, relative to the longitudinal axis of each row of apertures 36. As a result of such an alternating arrangement of the passages, gas emitted from apertures 36 will tend simultaneously to tension the web longitudinally in the direction of curved portion 52; and to tension the web transversely to longitudinal axes 18, 20 and thus flatten the web to surfaces 32, 34. Apertures 36 preferably are arranged in parallel rows extended longitudinally of each plate between ends 22, 24 and 26, 28. For the aperture size, operating pressure and materials mentioned previously, the longitudinal spacing δ between apertures 36 may be approximately 8.38 mm; and the transverse spacing γ between rows of apertures may be approximately 31.88 mm. In the embodiments of FIGS. 1 and 2, the alternately directed passages may be in rows having a transverse spacing ε of approximately 1.9 mm.

As shown in FIG. 2, control surfaces 132; 134 may be discontinuous with one or more venting grooves 154 provided between the rows of apertures, the grooves being parallel to the rows. The transverse width and depth of grooves 154 may be approximately 3.18 mm and the transverse spacing between the grooves may be approximately 19 mm with the rows of apertures centrally located between the grooves. The separate surfaces between grooves 154 comprise control surfaces 132, 134 and need not be coplanar, as much as 1.02 mm variation from coplanarity being acceptable for the arrangements and web materials previously described.

Figure 3:
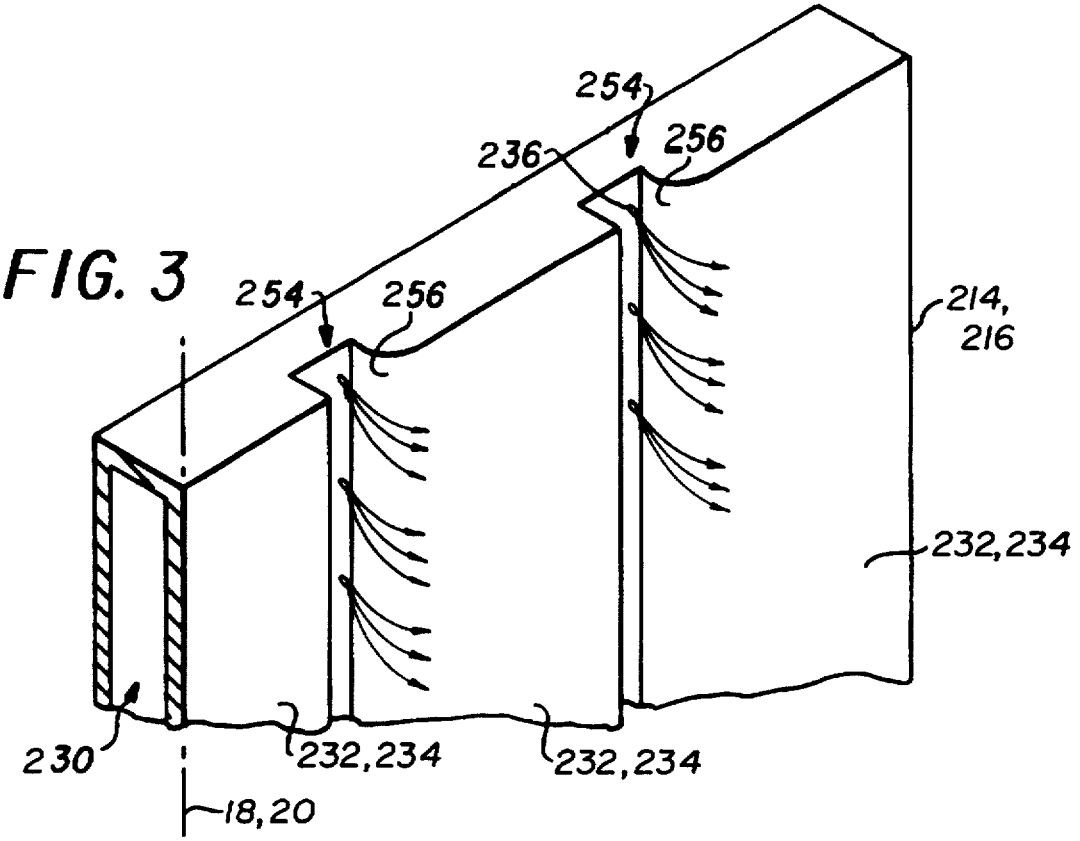
FIG. 3 illustrates schematically a perspective view of an alternative geometry for the apertures and grooves.

Alternatively, as shown in FIG. 3, upstream and downstream tensioning wall members 214, 216 include a plenum 230 and control surfaces 232, 234. The apertures 236 advantageously may be situated within grooves 154 in web control surfaces 132, 134 of upstream and downstream wall members 114, 116 and directed to tangentially engage a radiused or curved side 256 of the groove to use the Coanda effect to distribute the localized disturbance force of the gas stream over a greater area. The Coanda effect at the curved edges causes the flows from the apertures to attach themselves to and follow curved side 156 in a laminar type flow and then to exhaust into the next adjacent exhaust groove. The apertures may be located next to the base of curved side 256, as illustrated, or more centrally on the bottom surface of the groove. For a groove sized and spaced as previously described, curved side 256 may have a radius of curvature of approximately 1.59 mm. On each side of the longitudinal axis 18, 20 of the control surface, curved side 56 should be the side of the groove further from the axis; so that, the streams of gas are directed toward opposite edges of the surface on opposite sides of the axis.

Figure 4:
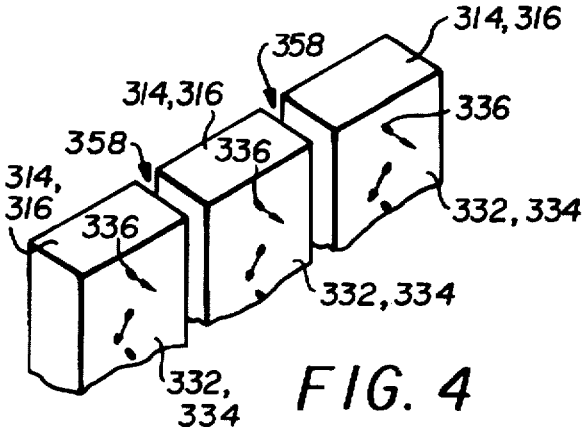
FIG. 4 illustrates schematically and fragmentarily a perspective view of yet another embodiment of the invention in which the control surface is comprised of smaller units separated by open longitudinal channels.
Figure 5:
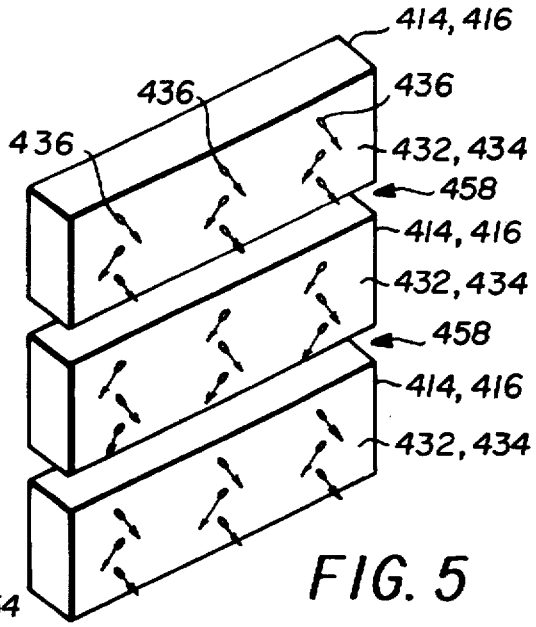
FIG. 5 illustrates schematically a perspective view of a further embodiment of the invention comprised of smaller units separated by open transverse channels.

FIG. 4 shows how an alternative control surface 332, 334 may be comprised of surfaces of a plurality of smaller tensioning plates 314, 316 separated by open channels 358. FIG. 5 shows how yet another alternative control surface 432, 434 may be comprised of a plurality of smaller tensioning plates 414, 416 separated by open channels 458. Plates 314, 316, 414, may be arranged essentially vertically and parallel as in FIG. 4 or horizontally and parallel as in FIG. 5 or at any suitable intermediate angle. In the embodiment of FIG. 4, the central rows of passages 336 extend along each plate 314, 316; whereas, in the embodiment of FIG. 5, the rows of passages 436 extend from plate 432, 434 to plate 432, 434.

Figure 6:
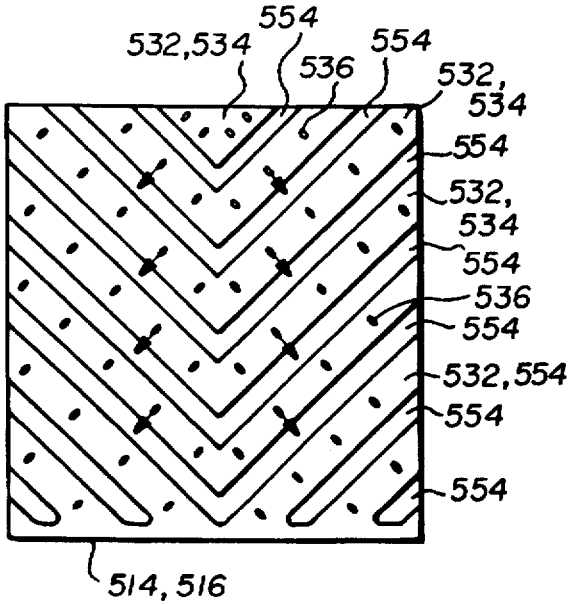
FIG. 6 illustrates schematically a plan view of a tensioning plate including chevron-shaped rows of apertures separated by similarly shaped exhaust grooves.
Figure 7:
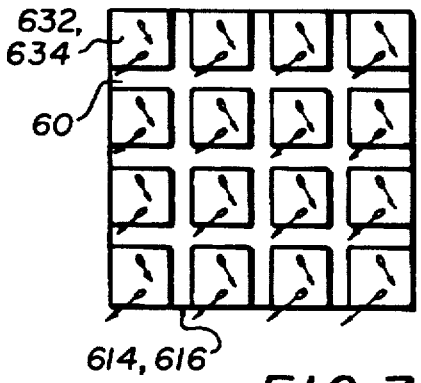
FIG. 7 illustrates schematically a plan view of a tensioning plate including a rectangular array of smaller control surfaces separated by a rectangular grid of exhaust grooves.

As shown in FIG. 6, in still another embodiment, tensioning plates 514, 516 have control surfaces 532, 534 wherein the passages 536 may be arranged in a chevron-shaped pattern between chevron-shaped exhaust grooves 554 in control surfaces 532, 534, in much the same manner as in commonly assigned U.S. Pat. No. 4,493,548, the contents of which are incorporated by reference into this specification. FIG. 7 illustrates yet another embodiment of tensioning plates 614, 616 in which a plurality of smaller rectangular control surfaces 632, 634 are spaced from each other by a rectangular grid of exhaust grooves 660. Those skilled in the art will appreciate that a variety of shapes of smaller control surfaces and channels may be used without departing from my invention.

Thus the flows of gas from apertures 136, 236, 336, 436, 536 establish curtains of air along control surfaces 532, 534, 632, 634, 132, 134, 232, 234, 332, 334, 432, 434 which, due to the Bernoulli effect, exert both a lifting force normal to the web and holding force to support the web a predetermined distance above the surface. This distance is a function of the rate of gas flow from the apertures, the inclination angle α, the orientation angle β, the diameter of the apertures, the distance δ between the rows of apertures, and the distance between the exhaust grooves. These same variables also govern the magnitude of the axial and transverse tensioning forces applied to the web due to viscous drag effects.

Advantageous Effect of the Invention

The apparatus of my invention shares with conventional vacuum box accumulators the advantage of accumulating webs without any moving parts and thus minimizes tension variations in the web during web-indexing movements. Unlike vacuum boxes, however, the apparatus of my invention will accept webs of various widths to be accumulated successively or concurrently side by side without modification of the apparatus. The apparatus has several additional advantages relative to vacuum boxes when used with very thin (less than 20 μm) and relatively wide (greater than 16 mm) webs, which are very fragile and prone to developing static charges. Firstly, the apparatus is much easier to use in a production environment since its very open construction facilitates either manual or automatic threading means. Secondly, since the apparatus accumulates web completely without contact, including edge contact, the ever-present concern of edge damage on such thin webs is eliminated, which otherwise might cause a catastrophic tear.

While my invention has been shown and described with reference to particular embodiments thereof, those skilled in the art will understand that other variations in form and detail may be made without departing from the scope and spirit of my invention.

Parts list

10—apparatus for accumulating and tensioning web
12—face plate
14—upstream pneumatic tensioning plate or wall member
14'—smaller tensioning plate
16—downstream pneumatic tensioning plate or wall member
16'—smaller tensioning plate
18—longitudinal axis of 14

20—longitudinal axis of 16
22—upper end of 14
23, 25—edges of 14
24—lower, opposite end of 14
26—upper end of 16
27, 29—edges of 16
28—lower, opposite end of 16
30—interior plenum of 14, 16
32—web control surface of 14
34—web control surface of 16
36—passage or aperture through 32, 34 from 30
38—source of pressurized gas
α—acute exit angle of 36 above 32, 34
40—conventional air bar
42—conventional air bar
44—web
46—space between 32, 34 open to ambient at both ends
48—incoming span of web
50—outgoing span of web
52—central curved portion joining 48, 50
54—exhaust grooves
54'—chevron exhaust grooves
56—radiused side or edge of 54
β—acute angle of 36 to one side or other of longitudinal row
δ—longitudinal spacing between apertures
γ—transverse spacing between rows of apertures
ε—transverse spacing between oppositely directed apertures
58—open channels between 14', 16'
60—rectangular grid of exhaust grooves

Having thus described my invention in sufficient detail to enable those skilled in the art to make and use it, I claim as new and desire to secure Letters Patent for:

1. An apparatus for applying tension to a web comprising:

a first tensioning wall member including a first control surface with a first plurality of apertures therein arranged in a pattern and having an upper end and a lower end;

a second tensioning wall member including a second control surface with a second plurality of apertures therein arranged in a pattern and having an upper end and a lower end and, said second control surface facing said first control surface, said second control surface being downstream from said first control surface;

a web accumulation space having an open top open to ambient pressure between said first and second control surfaces, said web accumulation space adapted to receive a loop portion of a traveling web;

means for guiding the traveling web through said open top into said web accumulation space and means for guiding the traveling web through said open top out of said web accumulation thereby forming the loop portion of the traveling web in said web accumulation space the loop portion having an incoming span and an outgoing span, the incoming span residing adjacent said first control surface and moving in a generally downward direction, the outgoing span residing adjacent said second control surface, the outgoing span moving in a generally upward direction;

a first plurality of flows of gas emitted through said first plurality of apertures into said web accumulation space, said first plurality of flows of gas flowing between said first control surface and said incoming span, each of said first plurality of flows of gas including a substantial component directed in the direction travel of the incoming span; and a second plurality of flows of gas emitted through said second plurality of apertures into said web accumulation space, said second plurality of flows of gas flowing between said second control surface and said outgoing span, each of said second plurality of flows of gas including a substantial component directed opposite the direction of travel of the outgoing span.

2. An apparatus as recited in claim 1 further comprising:

a first plenum in said first tensioning wall member, said first plurality of apertures communicating with said first plenum; and a second plenum in said second tensioning wall member, said second plurality of apertures communicating with said second plenum.

3. An apparatus as recited in claim 1 further comprising:

a first guide means for guiding said traveling web into said web accumulation space; and a second guide means for guiding said traveling web out of said web accumulation space.

4. An apparatus as recited in claim 3 wherein:

said first and second guide means are air bars.

5. An apparatus as recited in claim 3, wherein:

said first control surface is substantially parallel to said second control surface.

6. An apparatus as recited in claim 5 wherein:

said first control surface and said second control surface are substantially flat.

7. An apparatus as recited in claim 1 wherein:

said first control surface and said second control surface each includes side edges, each of said first plurality of flows of gas including a substantial component directed toward said side edges of said first control surface, and each of said second plurality of flows of gas including a substantial component directed toward said side edges of said second control surface.

8. An apparatus as recited in claim 7 wherein:

said first plurality of apertures are acutely angled relative to said side edges of said upstream web control surface, said second plurality of apertures are acutely angled relative to said side edges of said downstream web control surface.

9. In combination, an apparatus for applying tension to a traveling web comprising:

an upstream tensioning wall member including at least one first control surface with a first plurality of apertures therein and having an upper end and a lower end;

a downstream tensioning wall member including at least one second control surface with a second plurality of apertures therein and having an upper end and a lower end and, said at least one second control surface facing said at least one first control surface;

a web accumulation space open to ambient pressure between said at least one first control surface and said at least one second control surface;

a traveling web including a loop portion residing in said web accumulation space, said loop portion having an incoming span traveling generally downward and an outgoing span traveling generally upward, said incoming span residing adjacent said at least one first control surface, said outgoing span residing adjacent said at least one second control surface, said outgoing span being downstream of said incoming span;

a first plurality of flows of gas emitted through said first plurality of apertures, each of said first plurality of flows of gas including a substantial component directed in the direction of travel of said incoming span; and a second plurality of flows of gas emitted through said second plurality of apertures, each of said second plurality of flows of gas including a substantial directed opposite the direction of travel of said outgoing span.

10. A method for applying tension to a web comprising the steps of:

guiding a traveling web into a web accumulation space between an upstream web control surface and a downstream web control surface;

guiding the traveling web out of the web accumulation space;

forming a loop of web in the web accumulation space, the loop of web having an incoming span and an outgoing span;

causing the incoming span to travel generally downward adjacent the upstream web control surface;

causing the outgoing span to travel generally upward adjacent the downstream web control surface;

emitting a plurality of gas flows with a substantially downwardly directed component between the upstream web control surface and the incoming span; and emitting a plurality of gas flows with a substantially downwardly directed component between the downstream web control surface and the outgoing span.

11. A method as recited in claim 10 wherein:

said first listed emitting step employs a plurality of apertures in the upstream web control surface, and said second listed emitting step employs a plurality of apertures in the downstream web control surface.

12. A method as recited in claim 11 wherein:

the upstream web control surface and the downstream web control surface each includes side edges, each of the plurality of gas flows of said first listed emitting step including a substantial component directed toward the side edges of the upstream web control surface, and each of the plurality of gas flows of said second listed emitting step including a substantial component directed toward the side edges of the downstream web control surface.

13. A method as recited in claim 10 further comprising the steps of:

providing the upstream web control surface with a first plurality of spaced apart apertures therein, said first listed emitting step being performed through the first plurality of spaced apart apertures;

providing the downstream web control surface with a second plurality of spaced apart apertures therein, said second listed emitting step being performed through the second plurality of spaced apart apertures.

* * * * *